US005392475A

United States Patent [19]

McCall et al.

[11] Patent Number: 5,392,475

[45] Date of Patent: Feb. 28, 1995

[54] EXTENSIBLE ARTICLE OF FURNITURE

[76] Inventors: Gene W. McCall, 341 Union Valley Rd., Mahopac, N.Y. 10541; Pat Jones, 19 Stillman La., Pleasantville, N.Y. 10570

[21] Appl. No.: 519,730

[22] Filed: May 7, 1990

[51] Int. Cl.[6] ..... A47C 17/13; A47C 17/32

[52] U.S. Cl. ..... 5/18.1; 5/185

[58] Field of Search ..... 5/18.1, 17, 181, 184, 5/185

[56] References Cited

U.S. PATENT DOCUMENTS 327,829 10/1985 Simpson ..... 5/17

692,140 1/1902 Hutchinson et al. ..... 5/18.1

FOREIGN PATENT DOCUMENTS 217181 1/1942 Switzerland ..... 5/18.1

249328 6/1947 Switzerland ..... 5/181

*Primary Examiner*—Alexander Grosz

*Attorney, Agent, or Firm*—Rosenman & Colin

[57] ABSTRACT

An extensible article of furniture suitable for use as a convertible sofa bed or an extensible bed having a pair of substantially identical frame members with end boards and side rails being interlocked with surface slats affixed to the side rails of each frame member and being alternating with one another to form a slat surface of substantial rigidity providing suitable support for sofa and bed applications of the unit. Each of the frame members may provide four-point support from a supporting floor and contains markings for ease of selecting the desired positions of the frame members for use as a sofa or a bed of particular size.

16 Claims, 5 Drawing Sheets

EXTENSIBLE ARTICLE OF FURNITURE

BACKGROUND OF THE INVENTION

The present invention is concerned with an article of furniture which is extensible as to size.

Patent No. Re 5,275 to Caro discloses a bestsad having essentially three units including a center frame and extensible wings along each side of the center frame. The bedstead includes slidable bed slats alternately attached to the side wings for increasing the width of the bedstead from a single bed to a double bed. In Caro, a central spine or bar slidably supports the extensible bed slats with the extended bed having a six-point floor support arrangement.

Hart el al Patent No. 117,775 discloses an extension lounge in which an extension member can be withdrawn from the front edge of a couchlike lounge. The lounge when extended includes extension slats supported by the main frame and also by the extendable wing providing six-point floor support for the lounge when extended.

Streit Patent No. Re 9,099 also discloses an extension lounge for a reclining person in which a wing member is withdrawn from the side edge of a main frame with the extension slats slidably supported by the main frame and by the wing member with an overall six-point support system of the lounge as extended.

Pritchard No. 326,918 and DeVault No. 748,847 disclose extension beds with telescoping head and foot board members and sliding slats with intermediate supporting spines or rails to aid in supporting the bed slats when extended. Both of these patents disclose extension beds with four-point floor support.

The above reference patents represent the state of the art with respect to extension beds fabricated of hardwoods with subsequent prior art being directed to different materials or a combination of mechanisms for supporting extension beds including McKnight No. 1,037,283 which discloses an angle iron extensible bed where the extensible member is stored in and under a main frame and is moved to side-by-side position with the main frame to form a double bed. Stoltenberg No. 1,721,647 describes a bed davenport in which one of the members is stored within the other and withdrawn to extended position. Heumann No. 2,997,724 is directed to a stacked couch arrangement and Farkas No. 3,450,072 directed to a sidewise extensible article of furniture such as shelves or a bookcase.

Each of the foregoing patents is limited to either the concept of having four-point support in which the basic article of furniture is extended to increase its usable size with structural members supporting the extension slats within a four-point floor support system or to the concept of providing an additional two-point support for the extensible member resulting in an articulated piece of furniture having six supporting points. Additionally, the prior art in utilizing sliding bed slats does not disclose an arrangement for affixing the slat members at both ends to a main frame to provide a rigid frame structure.

Thus, while the foregoing extensible furniture achieves the advantage of conserving space as well as double utility there is, nonetheless, a sacrifice in comfort in that the supporting arrangements for the extension part are not as sturdy as those for the main frame. Additionally, by reason of sliding support of extensible wings on a main frame, the foregoing extensible beds lack the structural integrity needed for comfort in the bed configuration.

SUMMARY OF THE INVENTION

The present invention is directed to an extensible article of furniture which comprises interlocking frame means which enables the article to be adjusted as to size. More particularly, the extensible article of furniture according to the present invention includes such items as beds, sofas, tables, benches, and the like, but the construction described herein is not limited merely to those articles.

According to the present invention, an extensible article of furniture is constructed which has interlocking frames which provide a sliding telescopic movement, support means for the interlocking members and a suitable support to enable the article to stand or rest on a floor whether in a narrow, intermediate or fully extended position.

When the article of furniture, according to the present invention, is a bed, according to one embodiment, it comprises interlocking frames having end boards which provide sliding telescopic movement, side rails which support slat members which define the bed surface and which can support a mattress, futon, or the like, and suitable support means integral with or secured to the frame. According to another embodiment, a four-point support means is provided.

In this construction each of the frame members is provided with fixed slats which are alternated with the fixed slats of the other frame member and with the slats always supported by the side rails of their frame unit and by the inner side rail of the other frame unit ensuring a firm sofa bed or extensible surface. Additionally, the slats are spaced so as always to provide adequate support for the using person.

According to a further embodiment of the present invention, a circular bed is constructed utilizing the same interlocking frame structure.

The extensible article of furniture according to the present invention whether nested or articulated, always has a common support surface and as a result is particularly suited for use with a futon mattress which in one configuration is usable as a bed and in another configuration the mattress can be partially rolled to accommodate use in the nested or sofa configuration. Alternatively, futon or other mattresses may be stacked when nested and aligned side-by-side when extended.

The end boards which provide sliding telescoping movement for the convertible sofa bed or extensible bed can be marked to indicate the proper positions of the frame members for several uses, i.e., sofa, various bed sizes, etc.

The extensible article of furniture of the invention as indicated includes use as a convertible sofa bed, as for example, in a living room as well as use as an extensible bed in smaller or larger sizes, as for example, in a bedroom. In describing the invention, the term extensible furniture is intended to embrace each of these illustrative uses as well as others incurred in practice.

OBJECTS OF THE INVENTION

It is an object of the invention to provide an article of furniture which can be readily adjusted from fully nested to fully articulated or to any intermediate position as desired.

Another object of the invention is to provide an extensible article of furniture such as a convertible sofa bed having interlocking substantially identical frame members always providing four-point floor support for each unit and having extending slat members always providing a common supporting surface for use as a bed or sofa.

Another object of the invention is to provide an article of furniture particularly suited for use as a convertible sofa bed or extensible bed which has a configuration and design providing strength and comfort characteristics superior to known extension articles of furniture.

A further object is to provide extensible furniture which simplifies the extensible mechanism to (i) minimize maintenance, (ii) allow for quiet operation and, (iii) to allow for clean and elegant detailing.

Other and further objects of the invention will become apparent upon an understanding of the description of the preferred embodiment or upon employment of the invention in practice.

DESCRIPTION OF THE DRAWING

A preferred embodiment of the invention has been chosen for purposes of description and as shown in the accompanying drawing in which.

DETAILED DESCRIPTION

Figure 2:
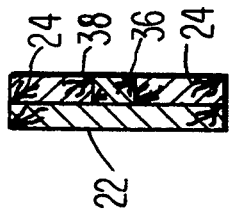
FIG. 2 is a section view taken along line 2—2 of FIG. 1.
Figure 1:
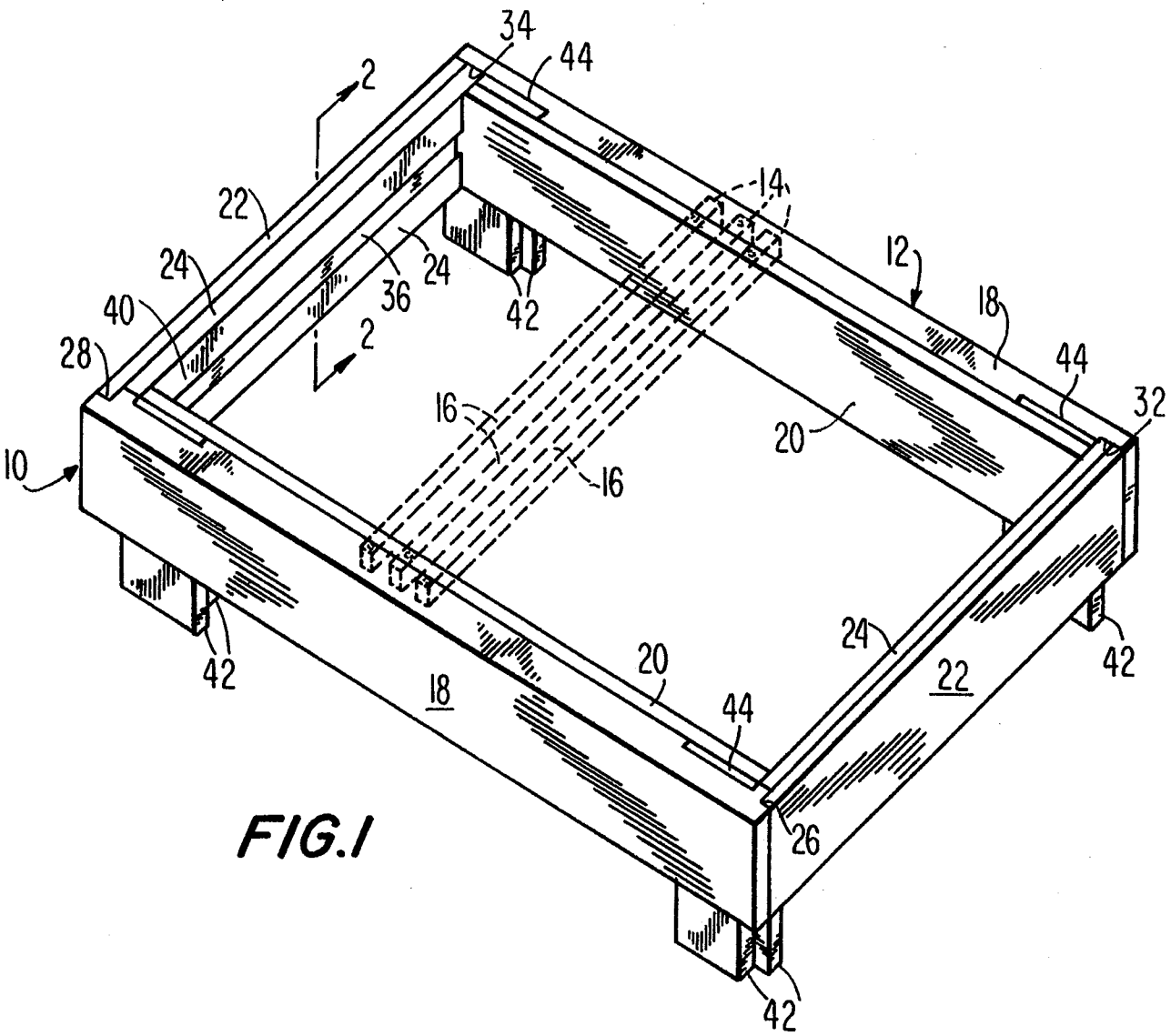
FIG. 1 is a perspective view of an extensible article of furniture in nested configuration for use as a sofa or smaller bed.
Figure 3:
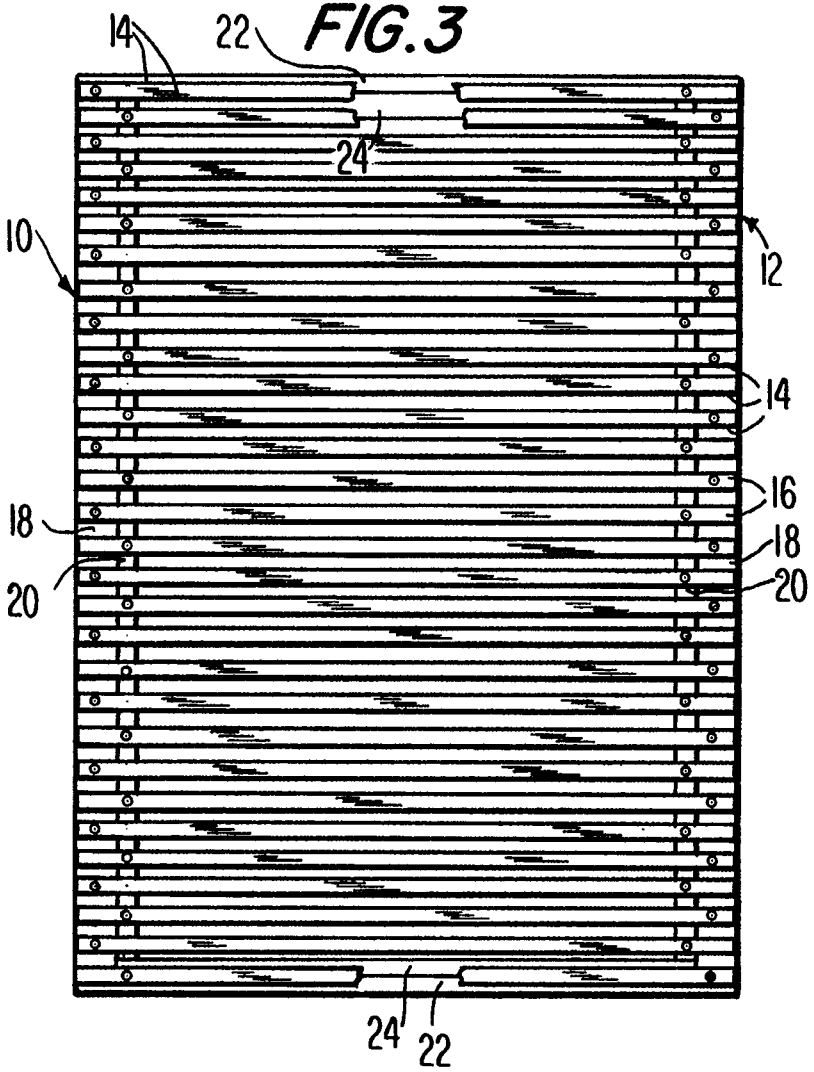
FIG. 3 is a plan view of the extensible article shown in FIG. 1.
Figures 4, 6:
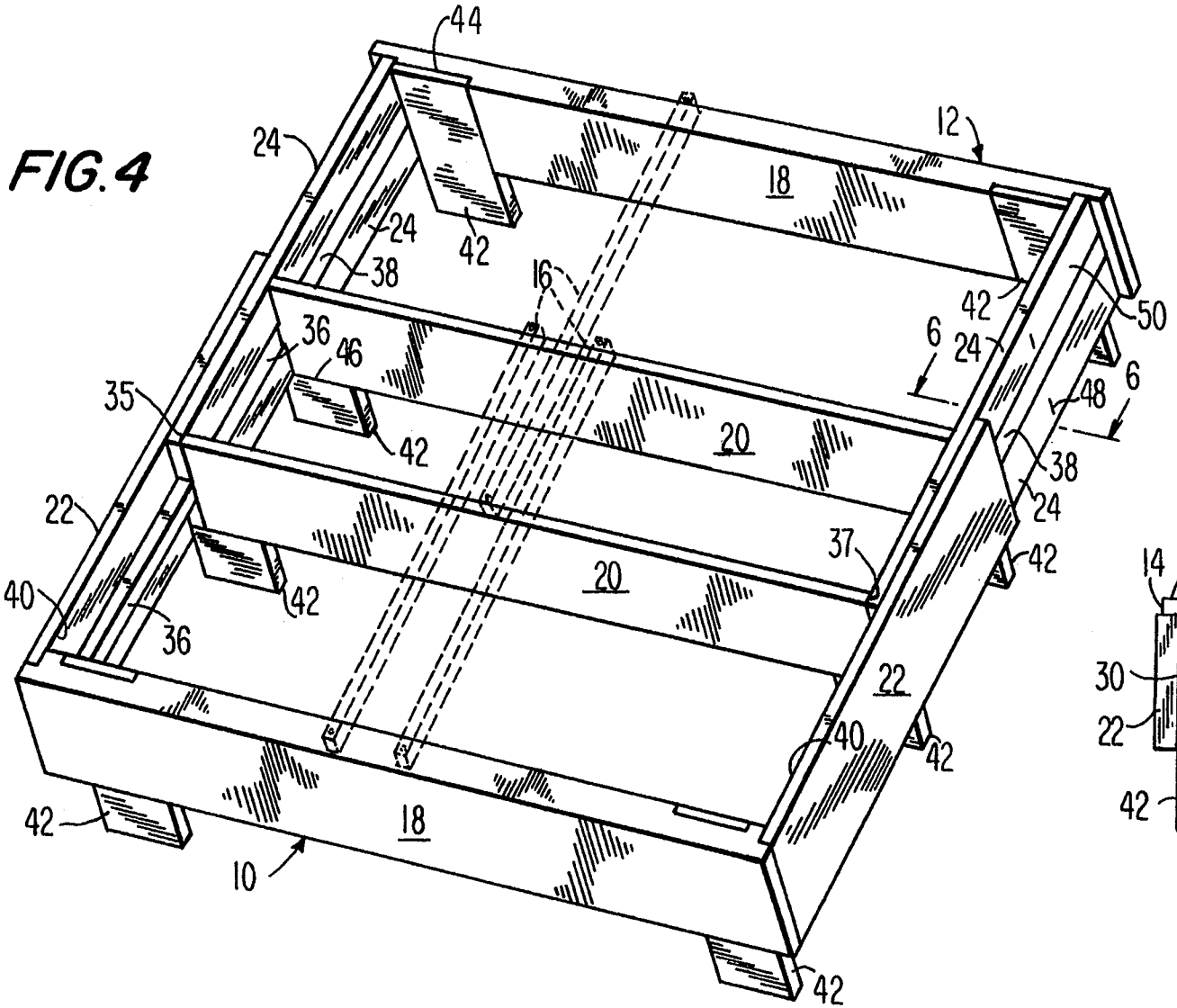
FIG. 4 is a perspective view of the extensible furniture in articulated or bed configuration.
FIG. 6 is a section view taken along line 6—6 of FIG. 4.
Figure 5:
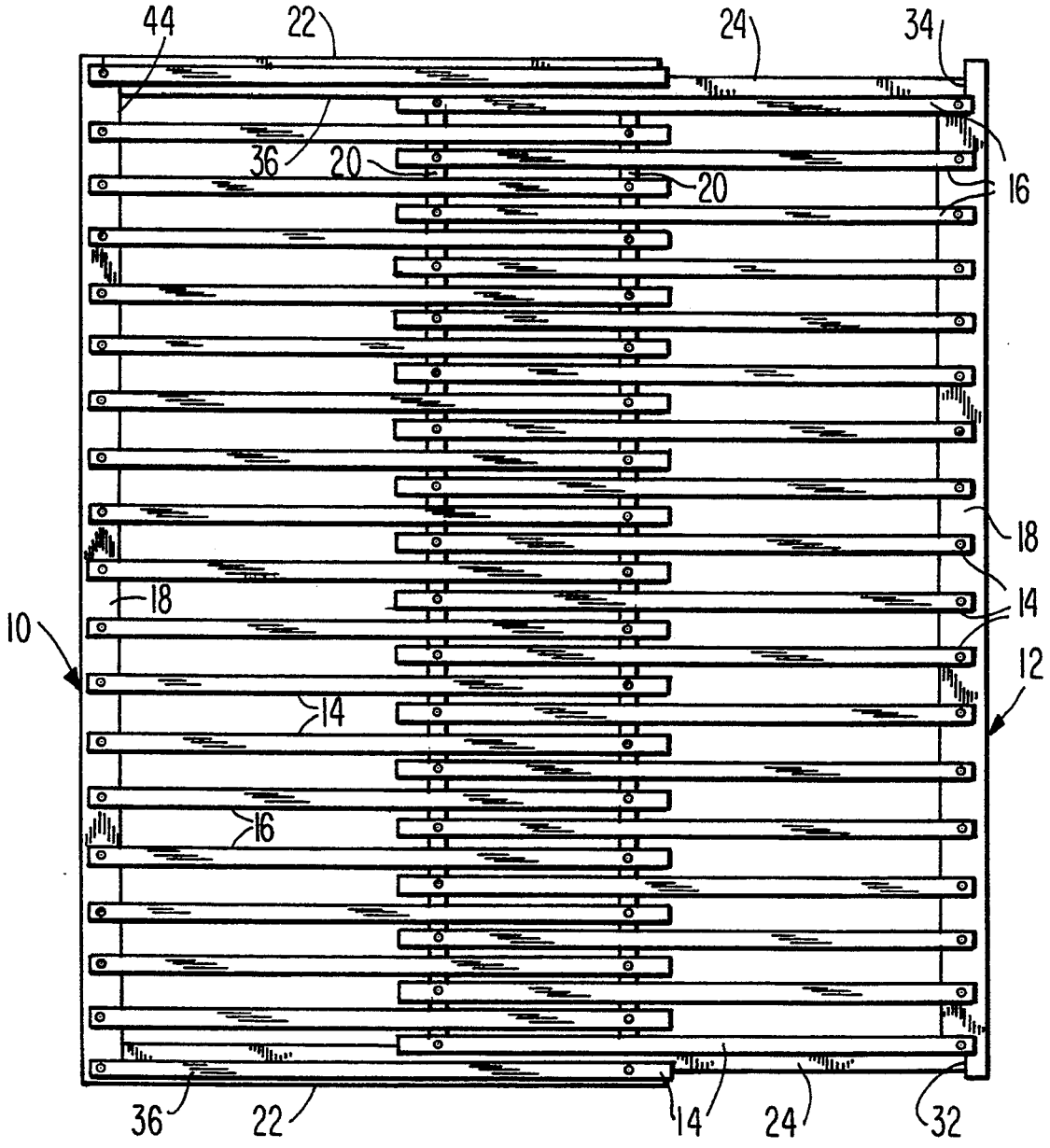
FIG. 5 is a plan view of the extensible furniture shown in FIG. 4.

Referring now to the drawing, FIGS. 1, 3 and 4, show the present invention in convertible sofa bed or extensible bed form which includes first and second frame members 10, 12 of substantially the same construction being interlocked and having a plurality of alternating slats 14 with top surfaces 16 collectively defining a sofa or bed surface.

The first and second frame members have substantially similar construction and include generally parallel outer 18 and inner 20 side rails and outer 22 and inner 24 end boards. In the embodiment of FIGS. 1–5, the outer end boards 22 are part of the first frame 10 while the inner end boards are part of the second frame 12.

As shown in FIGS. 1, 4, and 6 the first frame includes side rail 18 notched at its opposite ends 26 and 28 to receive one end of outer end boards 22 in generally perpendicular relationship and rigidly affixed thereto. The other end of each of end boards 22 is connected to the inner side rail 20 of the first frame 10 by means of a projection 30 extending through a groove in each of the inner end boards 24 and projecting into outer end boards 22 as shown in FIG. 6.

Referring still to FIGS. 1 and 4, the second frame member 12 includes outer side rail 18 with notches 32 and 34 at opposite ends to accommodate the end boards 22 and 24. The inner end boards 24 form part of the second frame and are secured in normal relationship to side rail 18 at notches 32 and 34 and also to inner rail 20 in butt joints 35 and 37.

The outer 22 and inner 24 end boards provide for telescoping movement of the first and second frames by means of a tongue 36 and groove 38 arrangement best shown in FIGS. 1 and 4. The inner surface 40 of each outer end board 22 is provided with tongue member 36 extending the full length of surface 40. Each tongue fits into and extends along a corresponding groove 38 substantially the full length of the inner end boards 24 when in the fully nested position but not when articulated.

Each frame includes pedestals or standards 42 to position the sofa bed above floor level. In the outer side rails 18, each pedestal is joined to its rail by means of a lap joint 44. The pedestal for the inner side rails are affixed by means of butt joints 46. While lap joints and butt joints are preferred other joints may be used or other means of connection of the pedestals can be employed. In the embodiment of FIGS. 1–6, each frame is provided with four pedestals located at the corners of the frame members. While this arrangement is preferred it is to be understood that other pedestal arrangements can be used to provide firm support of each frame member in the various degrees of extension of the frame members.

The result of this construction is extensible furniture comprising a pair of substantially similar frame members each having four-point floor support, being of rigid construction and interlocked for telescoping movement of a firm furniture surface for bed or sofa between nested (FIG. 1) and articulated positions (FIG. 4).

As shown in the drawing FIGS. 1–5, a plurality of slat members 14 are affixed to the side rails 18 and 20 of each frame with the slats alternately affixed to the first and second frame members. In the nested position (FIGS. 1 and 3) the slats form a surface 16 suitable for use as a sofa or smaller bed. In the articulated position (FIG. 5) the slats form a surface 16 suitable for use as a bed.

The units can be extended to any intermediate position between nested and fully articulated with four-point floor support for each of the frame members and with firm support of each of the slats to its respective unit frame providing an article of furniture of substantial rigidity. It will be observed in FIGS. 4 and 5 that the interlocked inner side rails 20 of each frame provide intermediate sliding support for the slats of the other frame, a feature that contributes to the rigidity and comfort of the piece when converted to bed configuration. The extensible furniture can be marked with suitable indicia 48 in order to indicate suitable positions for several configurations of the sofa bed. For example, the markings 48 are preferably made on the outer surface 50 of the inner end boards for queen size, king size beds and so forth. The markings can also be made on the surface 16 of slats near the end boards.

The extensible unit can be fitted with a suitable mattress such as a futon mattress which can be rolled into desired configuration or fully extended as desired. Several small futon or other mattresses can be stacked and/or rolled as well.

Figure 7:
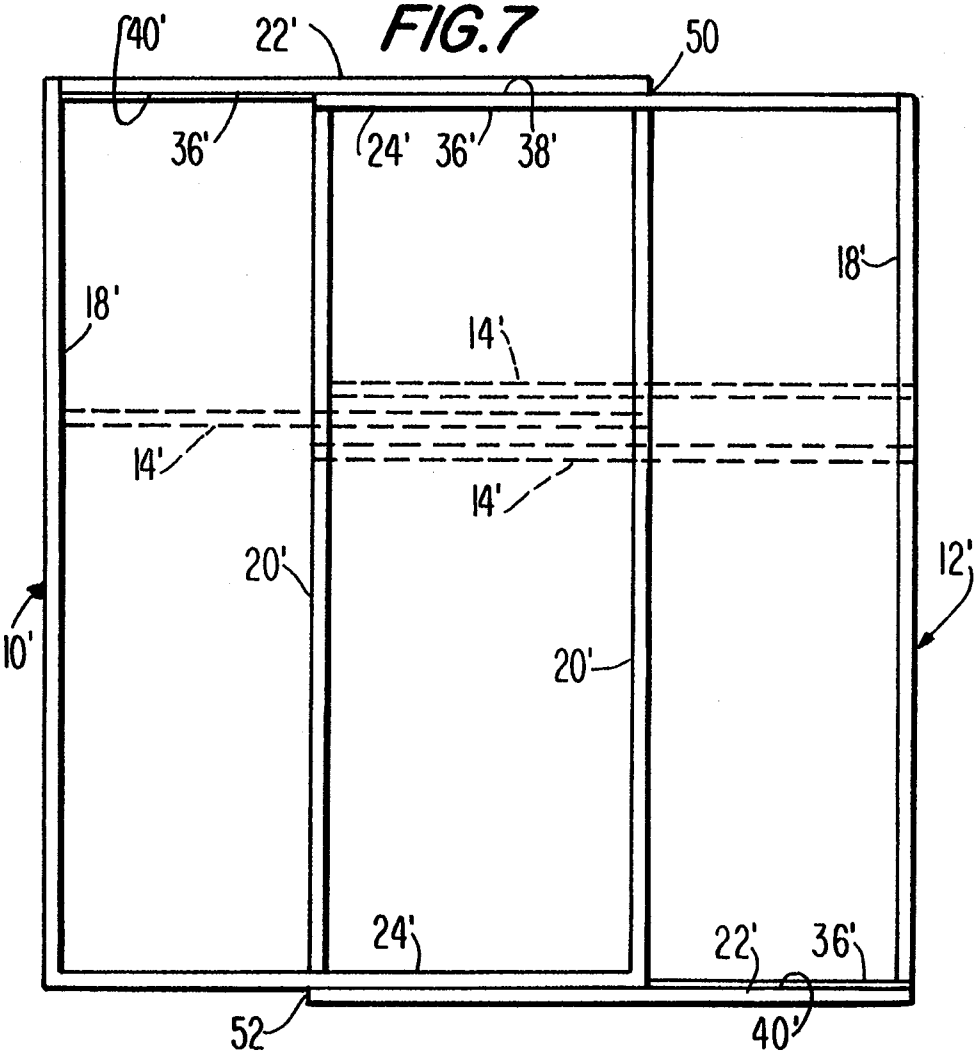
FIG. 7 is a schematic view of a modified form of extensible furniture according to the present invention.

In a modification of the invention the frame members 10', 12' can be assembled as shown in FIG. 7 in an offset interlocking arrangement where each frame has an outer 22' and inner 24' end board. In this arrangement the inner end boards are provided with grooves 38' to receive tongues 36' fitted to the inner surface of the outer end boards. Additionally, the side rail/end board joints 50, 52 at opposite corners are formed in the manner disclosed in FIG. 6. The slats 14' are affixed to the side rails of each frame substantially as in the preferred embodiment.

Figure 8:
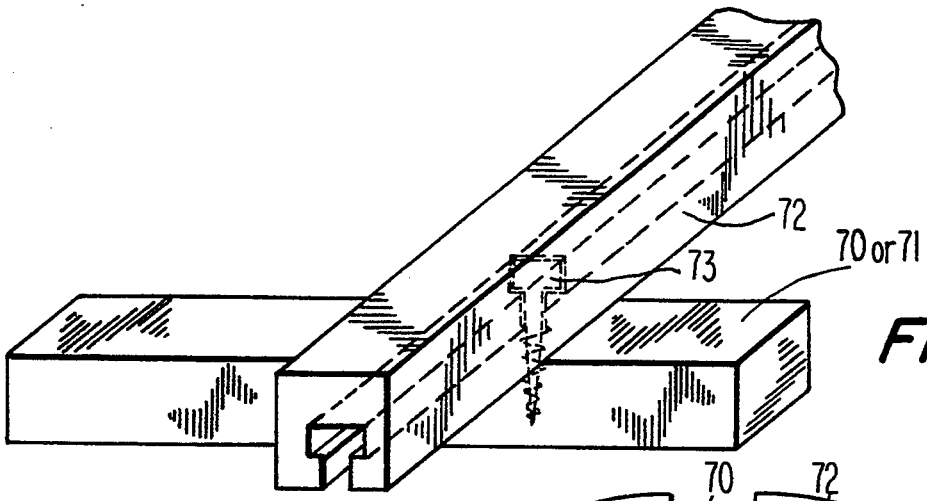
FIG. 8 is detail view of a circular bed according to the present invention.
Figure 9:
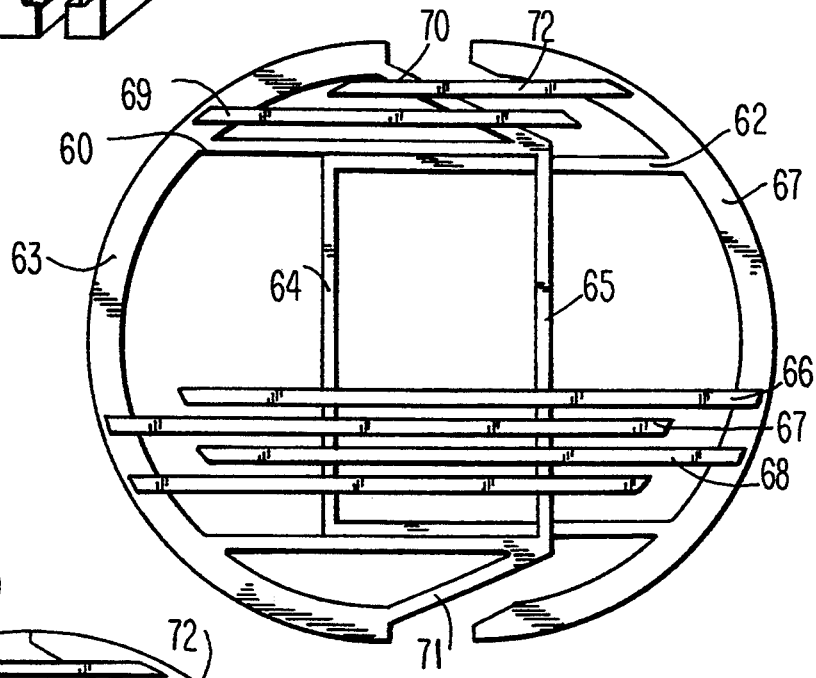
FIGS. 9 and 10 are plan views of a circular bed according to the present invention.
Figure 10:
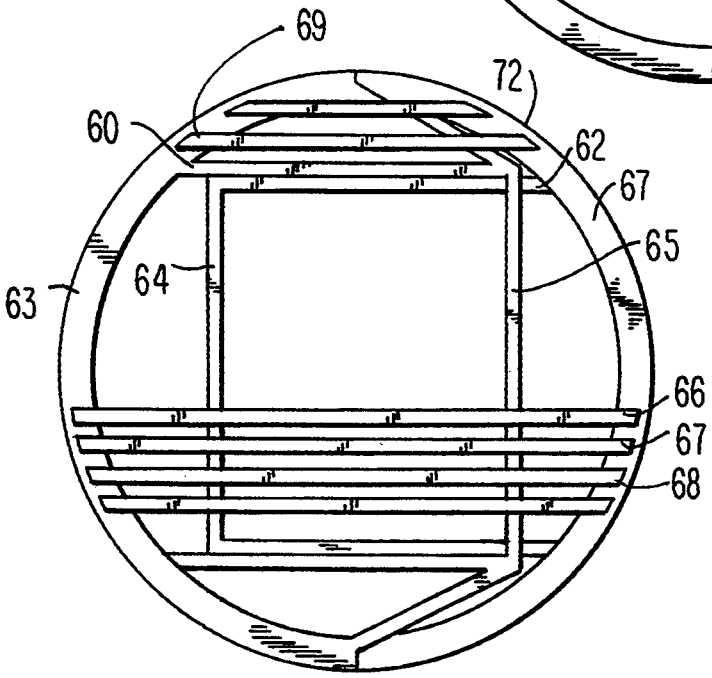

In the embodiment shown in FIGS. 8 to 10, a circular bed is shown having frame members 60 and 62, which are slidable in an interlocking arrangement as previously described. Outer support members 63 and 67, and inner support members 64 and 65, are similarly moveable as described above. A plurality of slats 66, 68 and 69, are alternately attached to and slide with, each frame as previously described. In this embodiment, frame members 70 and 71 are extensions of frame member 60, which serve to support the plurality of slats which are placed to the outside of the interlocking members 60 and 62. In this embodiment, any slats (72) associated with the second frame 62 and which are placed outside the interlocking members 60 and 62, are secured to the first frame by means of a sliding bolt and groove arrangement as shown in the detail drawing of FIG. 8. Slat 72 has a T shaped channel in which the bolt 73 slides. The bolt is permanently attached to the corresponding frame member 60 or 62 in the manner shown. This arrangement allows the slats 72 to move from the fully nested position to any articulated position along with the other slats, 66, 68 and 69, while still being held in a parallel arrangement with those slats.

We prefer to use hardwood for the main structural components particularly the frame members as well as exposed surfaces with joints and connections between component members being made for rigidity and permanence according to known woodworking skills.

The article of furniture of the present invention has been described in terms of a convertible sofa bed and extensible bed as preferred embodiments, however, it is to be understood that the principles of the invention are applicable to other articles of furniture when convertibility or extensibility as well as strength and rigidity are desired characteristics. The preferred embodiment of the invention is also shown and described in rectangular form, however, the principles of the invention are applicable to other configurations having similar characteristics of convertibility or extensibility, strength, and rigidity.

What is claimed is:

1. Extensible furniture comprising first and second telescoping interlocking frame members fitted with a multitude of alternating surface slats defining a furniture surface, each frame member having side rails and having a pair of end boards in generally parallel relationship joined to the ends of the side rails to form a rigid structure, the frame members being joined in interlocking relationship with one side rail of each frame located within the structure of the other frame and with end boards forming interlocked pairs at opposite ends of the frames, means for providing sliding telescoping movement of the interlocked end boards, a multitude of slats defining a furniture surface alternately affixed to the side rails of the first and second frame members, lying generally parallel to each other and to the end boards of the extensible furniture and with the slats of each frame being slidably supported by the interior side rail of the other frame, and means providing floor support for each frame.

2. Extensible furniture according to claim 1 in which the end boards of the first frame member are located outside the end boards of the second frame member, the outer end boards include tongue members and the inner end boards include grooves which cooperate with the tongue members to provide sliding telescoping movement of frame members.

3. Extensible furniture according to claim 1 in which the first and second frame members are assembled in offset interlocking relationship with each frame having outer and inner end boards, and with adjacent end boards having tongue and groove elements to accommodate telescoping movement of the frames.

4. Extensible furniture according to claim 1 which includes markings for indicating positions of the frame members for particular uses thereof.

5. Extensible furniture according to claim 1 in which the interlocked inner side rail of each frame provides sliding support for the slats of the other frame when the sofa bed is extended.

6. Extensible furniture comprising first and second telescoping interlocking frame members fitted with a multitude of alternating surface slats defining a furniture surface, each frame member having side rails and having a pair of end boards joined to the ends of the side rails to form a rigid structure, the frame members being joined in interlocking relationship with one side rail of each frame located within the structure of the other frame and with end boards forming interlocked pairs at opposite ends of the frames, means for providing sliding telescoping movement of the interlocked end boards, a multitude of slats defining a furniture surface alternately affixed to the side rails of the first and second frame members, and with the slats of each frame being slidably supported by the interior side rail of the other frame, and means providing floor support for each frame.

7. A convertible sofa bed comprising first and second telescoping interlocking frame members fitted with a multitude of alternating surface slats defining a sofa bed surface, each frame member having side rails in generally parallel relationship and having a pair of end boards in generally parallel relationship joined to the ends of the side rails to form a rigid boxlike structure, the frame members being joined in interlocking relationship with a side rail of each frame located within the boxlike structure of the other frame and with end boards forming adjacent pairs at opposite ends of the frames, means for providing sliding telescoping movement of the adjacent ends boards, a multitude of slats defining a sofa bed surface alternately affixed at each end to the side rails of the first and second frame members, lying generally parallel to each other and to the end boards of the sofa bed, and with the slats of each frame being slidably supported by the interlocked side rail of the other frame, and means providing floor support at the junction of each side rail and end board in each frame.

8. A convertible sofabed comprising first and second telescoping interlocking frame members fitted with a multitude of alternating surface slats defining a sofabed surface, each frame member having side rails in generally parallel relationship and having a pair of end boards in generally parallel relationship joined to the ends of the side rails to form a rigid box-like structure, the frame members being joined in interlocking relationship with a side rail of each frame located within the box-like structure of the other frame and with the end boards forming adjacent pairs at opposite ends of the frames, means for providing sliding, telescoping movement of the adjacent end boards, a multitude of slats defining a sofabed surface alternately affixed at each end to the side rails of the first and second frame members, lying generally parallel to each other and to the end boards of the sofabed, and with the slats of each frame being slidable supported by the interlocked side rail of the other frame, and means providing floor support at the juncture of each side rail and end board in each frame.

9. A sofabed according to claim 8 in which the end boards of the first frame member are located outside the end boards of the second frame member, the outer end boards include tongue members and the inner end boards include grooves which cooperate with the tongue members to provide sliding telescoping movement of the frame members.

10. A sofabed according to claim 8 in which the first and second frame members are assembled in offset interlocking relationship with each frame having outer and inner end boards, and with adjacent end boards having tongue and groove elements to accommodate telescoping movement of the frames.

11. A convertible sofabed according to claim 8 which includes markings for indicating the positions of the frame members for particular uses thereof.

12. A convertible sofabed according to claim 8 in which the interlocked inner side rail of each frame provides sliding support for the slats of the other frame when the sofabed is extended.

13. Extensible furniture comprising first and second telescoping interlocking frame members fitted with a multitude of alternating surface slats defining a furniture surface, each frame member having side rails and having a pair of end boards joined to the ends of the side rails to form a rigid structure, the frame members being joined in interlocking relationship with one side rail of each frame located within the structure of the other frame and with end boards forming interlocked pairs at opposite ends of the frames, tongue and groove means for providing sliding telescoping movement of the interlocked end boards, the multitude of slats defining a furniture surface alternately affixed to the side rails of the first and second frame members and with the slats of each frame being slidably supported by the interior side rail of the other frame, and means providing floor support for each side rail and end board of each frame.

14. An article of furniture suitable for use as a convertible sofabed comprising interlocking frame members slidable between fully nested and fully articulated positions, each frame member having side rails and end boards joined at their ends to form a four-sided frame member, the frame members having two inner and two outer end boards, the inner end boards being longitudinally divided to define grooves, side rail tenons projecting through the grooves formed by the divided end boards performing two end joints, said grooves accommodating sliding movement of the frame members with respect to one another between nested and articulated positions, longitudinal members affixed to the inner surface of the outer end boards in alignment with the grooves of the inner end boards to provide telescoping movement of the frames with respect to each other, a surface of furniture defined by a multitude of slats affixed at each of their ends to side rails of the frame member with adjacent slats affixed alternatively to the first and second frames and with the slats affixed to one frame being additionally supported in sliding movement by the interlock side rail of the other frame member and means providings floor support for each side rail and end board of the frame members.

15. An article of furniture according to claim 14 in which the inner end boards form part of one frame member and the tenons are affixed at opposite ends of a side rail of the other frame member.

16. An article of furniture according to claim 14 in which each frame has one inner end board and one side rail.

* * * * *